US012533548B2

(12) United States Patent
Tsai

(10) Patent No.: US 12,533,548 B2
(45) Date of Patent: Jan. 27, 2026

(54) TREADMILL HAVING WALKING BOARD ASSEMBLY WITH LOW FRICTION RESISTANCE AND HIGH LUBRICATION

(71) Applicant: Yu-Lun Tsai, Taichung (TW)

(72) Inventor: Yu-Lun Tsai, Taichung (TW)

( * ) Notice: Subject to any disclaimer, the term of this patent is extended or adjusted under 35 U.S.C. 154(b) by 128 days.

(21) Appl. No.: 18/733,610

(22) Filed: Jun. 4, 2024

(65) Prior Publication Data

US 2025/0367498 A1 Dec. 4, 2025

(51) Int. Cl.
*A63B 22/02* (2006.01)

(52) U.S. Cl.
CPC ..... *A63B 22/02* (2013.01)

(58) Field of Classification Search
CPC . A63B 22/0046; A63B 22/02; A63B 22/0207; A63B 22/0214; A63B 71/0054; A63B 2071/0063; A63B 2209/00
See application file for complete search history.

(56) References Cited

U.S. PATENT DOCUMENTS 6,572,512 B2 * 6/2003 Anderson ..... A63B 22/0207 482/54
2010/0105527 A1 * 4/2010 Johnson ..... A63B 22/02 482/54
2013/0263418 A1 * 10/2013 Johnson, Jr. ..... B32B 38/08 156/279
2014/0295140 A1 * 10/2014 King ..... A43B 5/005 428/156
2021/0220695 A1 * 7/2021 Tsai ..... A63B 71/0054
2022/0062698 A1 * 3/2022 Tsai ..... A63B 22/0285
2025/0213914 A1 * 7/2025 Tsai ..... A63B 22/0214
2025/0213915 A1 * 7/2025 Tsai ..... A63B 22/0207

FOREIGN PATENT DOCUMENTS

CN 108635744 A * 10/2018 ..... A63B 22/0285
CN 222752506 U * 4/2025
TW M659642 U * 8/2024
TW 1868012 B * 12/2024 ..... A63B 22/02

* cited by examiner

*Primary Examiner* — Gary D Urbiel Goldner
(74) *Attorney, Agent, or Firm* — LANWAY IPR SERVICES; Chun-Ming Shih

(57) ABSTRACT

A treadmill includes a walking board assembly, and a walking belt encircling the walking board assembly. The walking board assembly includes a support plate, a wear-resistant plate mounted on the support plate, and a wax layer mounted on the wear-resistant plate. The wear-resistant plate is made of wear-resistant material with a low friction coefficient. The wear-resistant plate has a bottom face abutting a top face of the support plate. The wear-resistant plate has a top face integrally formed with multiple grooves. The wear-resistant plate has a thickness less than that of the support plate. The wax layer is coated on and filled with the grooves of the wear-resistant plate. The wax layer has a coating height at least equal to a depth of each of the grooves.

10 Claims, 5 Drawing Sheets

TREADMILL HAVING WALKING BOARD ASSEMBLY WITH LOW FRICTION RESISTANCE AND HIGH LUBRICATION

BACKGROUND OF THE INVENTION

Field of the Invention

The present invention relates to an exercising machine and, more particularly, to a treadmill having a walking board assembly.

Description of the Related Art

A conventional treadmill comprises a walking board, and a walking belt mounted around the walking board. The walking belt rotates on the walking board along a closed trajectory, to facilitate the user stepping or running on the walking board successively. However, the walking belt always rubs the walking board so that a large amount of friction between the inner face of the walking belt and the top face of the walking board will quickly wear and shorten the lifetime of the walking belt and the walking board during a long-term utilization. In addition, the frequent friction will produce powder and dust, increase the power consumption of the treadmill, and make the motor overheat. Further, the walking belt is not rotated on the walking board smoothly, so that the walking belt is moved too fast or too slowly, thereby causing danger to the user. Further, the friction resistance produces a high temperature which cannot be dissipated so that the walking belt and the walking board are worn quickly, thereby decreasing the lifetime of the treadmill.

A lubricating oil is applied on the walking board to decrease the friction. A secondary working procedure is used to grind the wooden walking board so that the walking board has a rough top face to facilitate the lubricating oil adhering to the walking board. Powder or dust is cleared after the secondary working procedure is finished. However, the grinding of the secondary working procedure is uneven, and the powder and dust on the top face of the walking board cannot be cleared completely, so that after the lubricating oil is sprayed on the walking board, the lubricating oil containing dust and dirt will quickly wear and tear the walking board, the walking belt, and the rollers. In addition, the walking belt cannot rotate smoothly, thereby causing danger to the user.

Moreover, the lubricating oil is always carried by the walking belt, so that the lubricating oil is consumed quickly or disappears. Thus, the user or operator has to add the lubricating oil during a short period of time. However, the lubricating oil cannot be sprayed to the walking board easily after the treadmill is assembled. When the lubricating oil is added too little, the lubricating effect is decreased, and the user has to add the lubricating oil frequently. When the lubricating oil is added too much, the lubricating oil will overflow from between the walking belt and the top face of the walking board, causing slippage between the walking belt and the rollers, and even causing oil stains on the ground. Besides, the user needs to replenish the lubricating oil after use during a period of time, thereby greatly causing inconvenience to the user, and thereby increasing the cost. In addition, the walking belt is easily damaged if the user forgets to refill the lubricating oil.

Furthermore, the inner face of the walking belt and top face of the walking board contact each other in a surface-to-surface manner so that the walking belt and the walking board have a larger contact area, thereby increasing the friction resistance. Thus, the user's weight applies a force on the walking belt and the walking board, a larger contact area exists between the walking belt and the walking board, and powder and dust are generated during a long-term utilization, so that the walking belt cannot be rotated smoothly.

BRIEF SUMMARY OF THE INVENTION

The primary objective of the present invention is to provide a treadmill having a walking board assembly with low friction resistance and high lubrication.

In accordance with the present invention, there is provided a treadmill comprising a walking board assembly, and a walking belt encircling the walking board assembly. The walking board assembly includes a support plate, a wear-resistant plate mounted on the support plate, and a wax layer mounted on the wear-resistant plate. The support plate is made of a composite wooden board. The wear-resistant plate is made of wear-resistant material. The wear-resistant plate is hard and has a low friction coefficient. The wear-resistant plate has a bottom face abutting a top face of the support plate. The wear-resistant plate has a top face integrally formed with multiple grooves. Each of the grooves has a depth of 0.01 mm to 0.2 mm. The wear-resistant plate has a thickness less than that of the support plate. The wax layer is coated on and filled with the grooves of the wear-resistant plate. The wax layer has a coating height at least equal to the depth of each of the grooves.

According to the primary advantages of the present invention, the inner face of the walking belt and the top face of the wear-resistant plate contact and rub each other in a surface to line manner, the wax layer in the grooves supplies the wax during a long period of time, and the wear-resistant plate has a wear-proof feature, so that the walking board assembly is resistant to wear, has low friction resistance, has high lubrication, extends the lubricating effect between the walking belt and the wear-resistant plate, does not produce powder and dust, reduces the electric current, increases the lifetime of the walking belt, the motor, and other parts of the walking board assembly, and reduces the noise due to friction.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
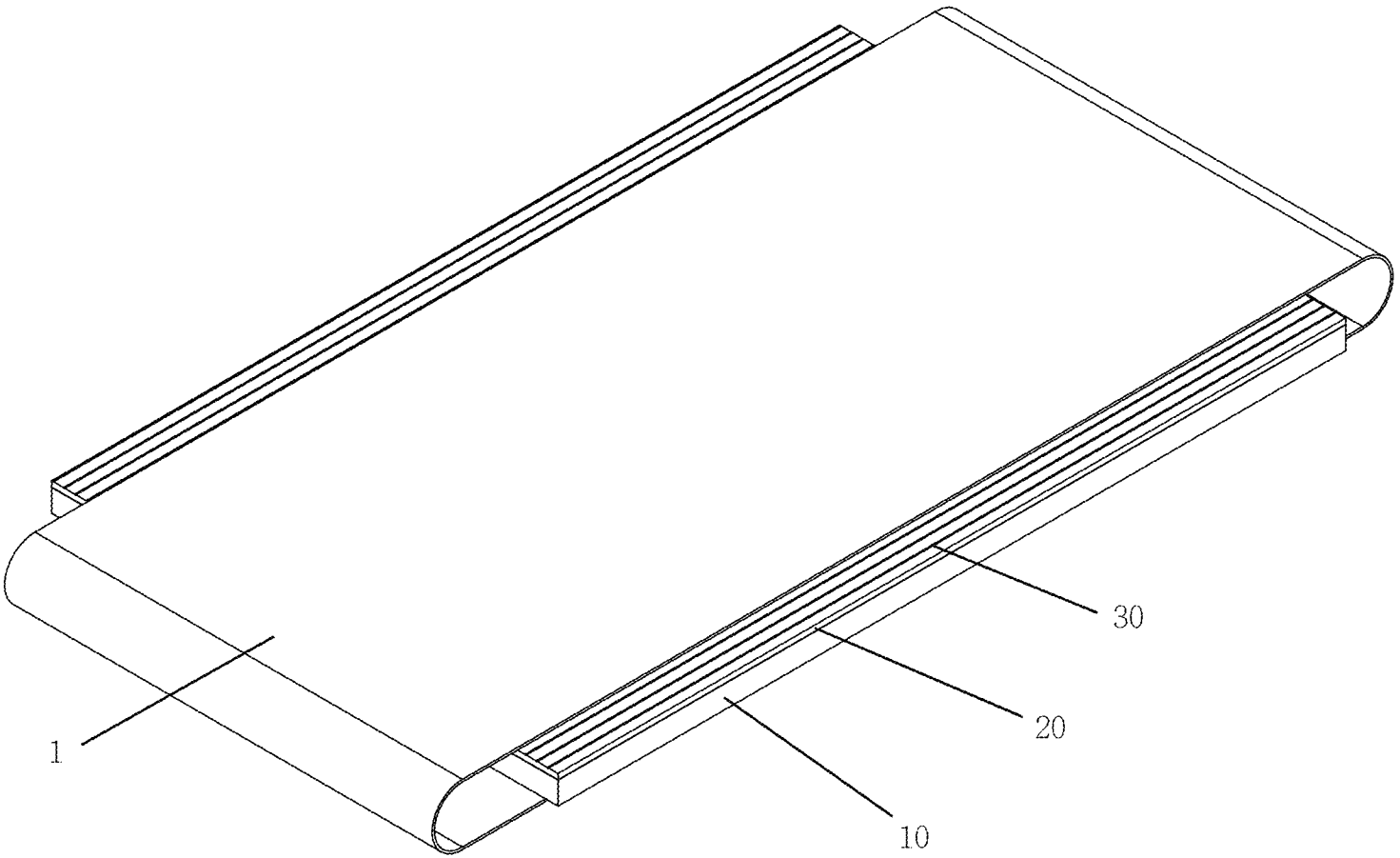
FIG. 1 is a perspective view of a treadmill in accordance with the first preferred embodiment of the present invention.
Figure 2:
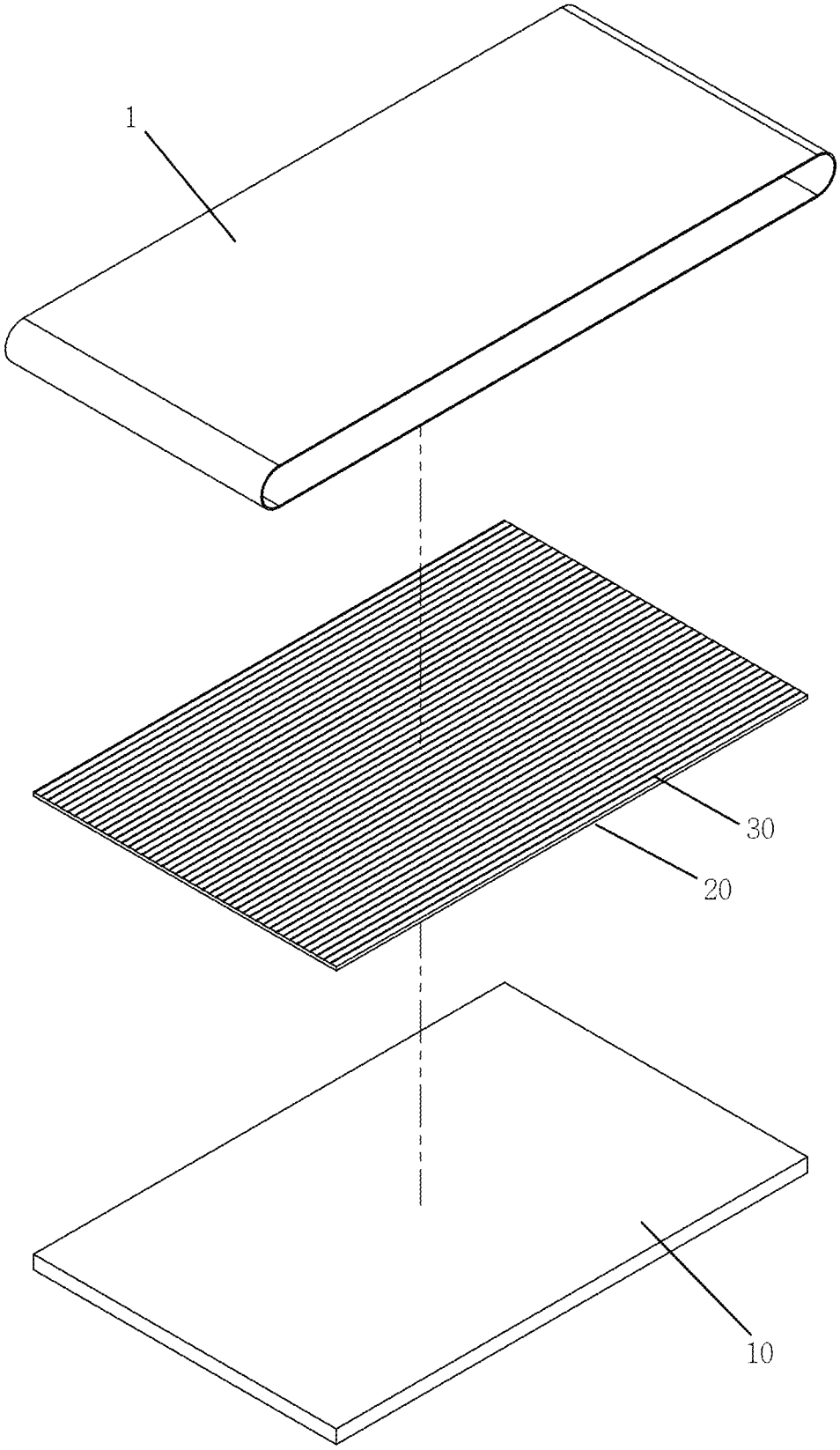
FIG. 2 is an exploded perspective view of the treadmill in accordance with the first preferred embodiment of the present invention.
Figure 3:
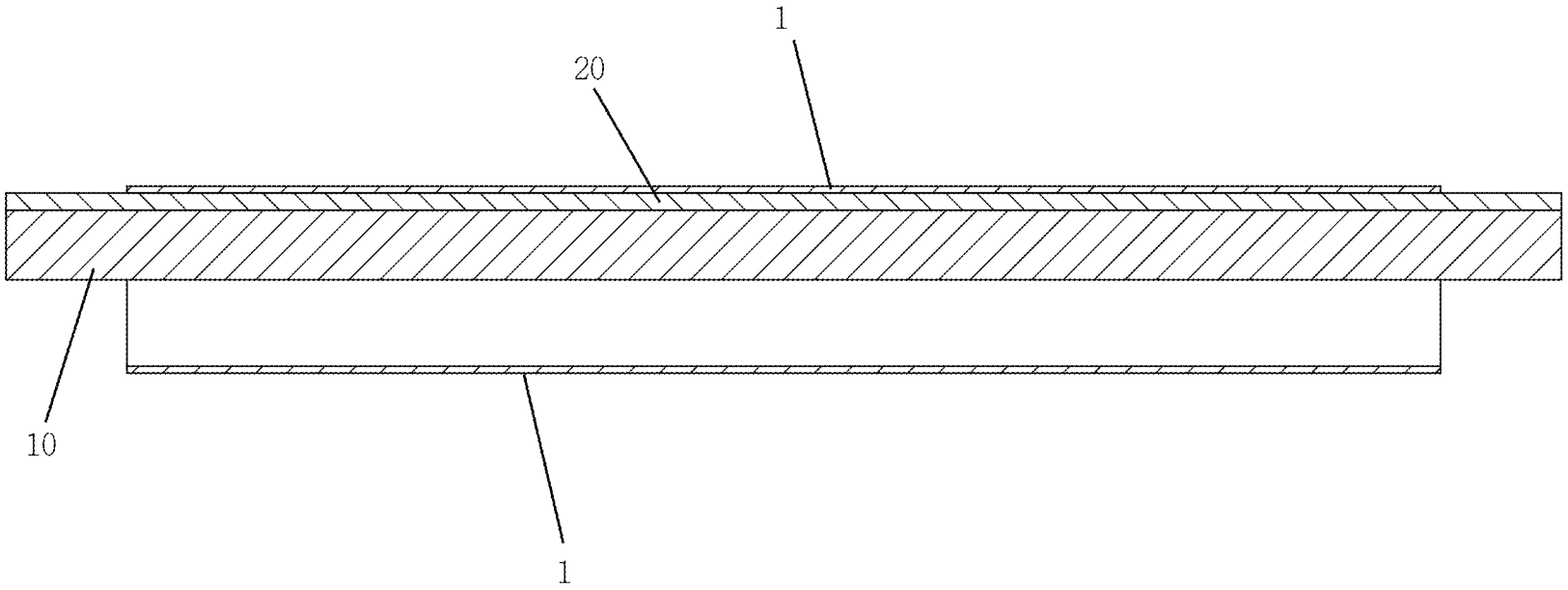
FIG. 3 is a side cross-sectional view of the treadmill as shown in FIG. 1.
Figure 4:
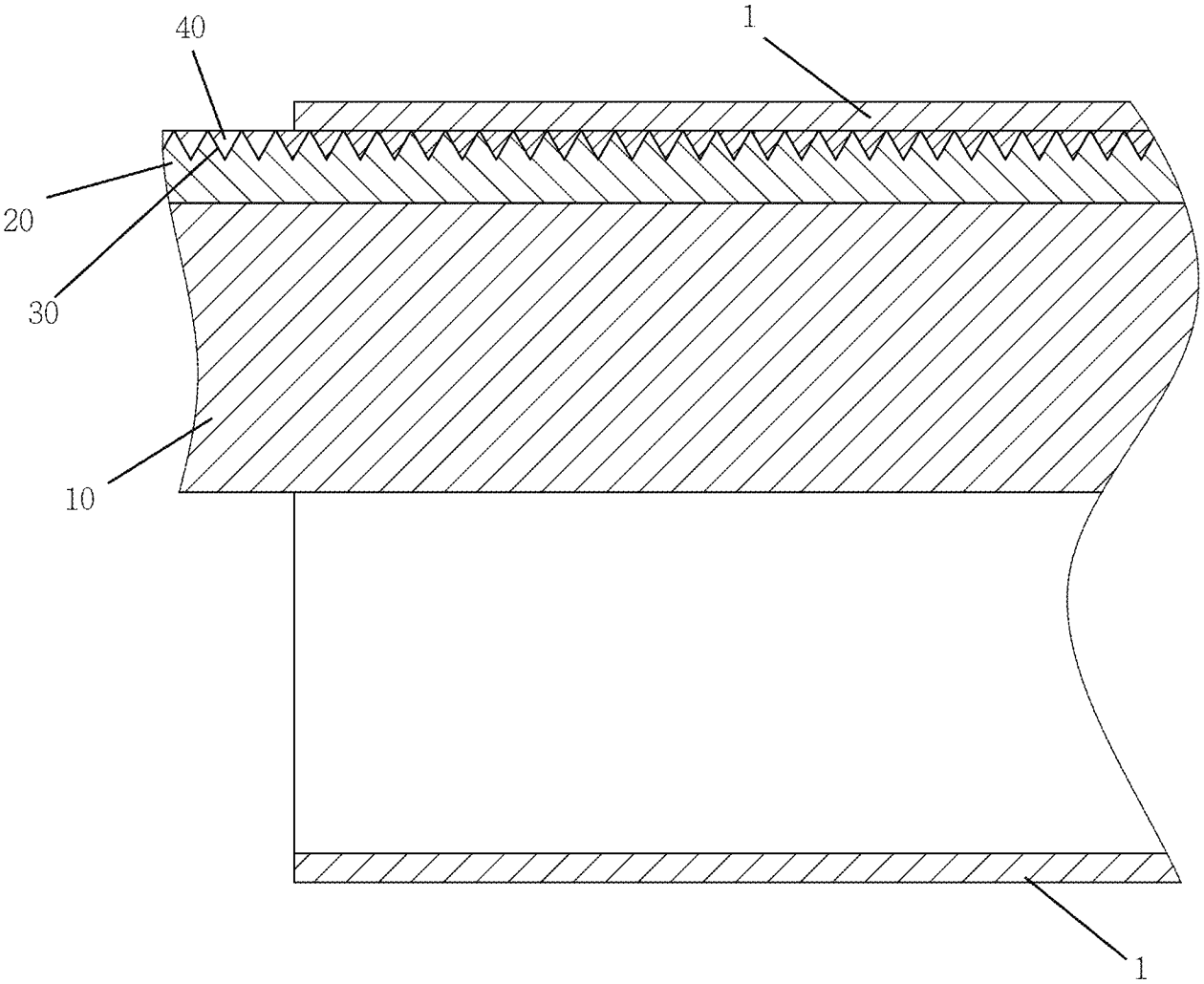
FIG. 4 is a locally enlarged view of the treadmill as shown in FIG. 3.

Referring to the drawings and initially to FIGS. 1-4, a treadmill in accordance with the preferred embodiment of the present invention comprises a walking (or running) board assembly, and a walking (or running) belt 1 encircling the walking board assembly. The walking belt 1 rotates on the walking board assembly along a closed trajectory, to facilitate the user stepping or running on the walking board successively.

The walking board assembly includes a support plate 10, a wear-resistant (or wear-proof) plate 20 mounted on the support plate 10, and a wax layer 40 mounted on the wear-resistant plate 20.

The support plate 10 is made of a composite wooden board.

The wear-resistant plate 20 is made of wear-resistant material. The wear-resistant plate 20 is hard and has a low friction coefficient. The wear-resistant plate 20 has a bottom face abutting a top face of the support plate 10. The wear-resistant plate 20 has a top face integrally formed with multiple grooves 30. Each of the grooves 30 has a depth of 0.01 mm to 0.2 mm. The wear-resistant plate 20 has a thickness less than that of the support plate 10.

The wax layer 40 is coated on and filled with the grooves 30 of the wear-resistant plate 20. The wax layer 40 has a coating height at least equal to the depth of each of the grooves 30.

In the preferred embodiment of the present invention, the coating height of the wax layer 40 is higher than and protrudes from the depth of each of the grooves 30.

In the preferred embodiment of the present invention, the coating height of the wax layer 40 is higher than the top face of the wear-resistant plate 20.

In the preferred embodiment of the present invention, each of the grooves 30 are arranged longitudinally in the top face of the wear-resistant plate 20 to correspond to a rotation direction of the walking belt 1. Alternatively, each of the grooves 30 are arranged transversely or obliquely in the top face of the wear-resistant plate 20.

In the preferred embodiment of the present invention, each of the grooves 30 are arranged regularly in the top face of the wear-resistant plate 20.

In the preferred embodiment of the present invention, each of the grooves 30 are arranged irregularly in the top face of the wear-resistant plate 20.

In the preferred embodiment of the present invention, the wear-resistant plate 20 is made of a high-pressure decorative laminate (or melamine board), a Bakelite board, a dense board, or a high-density wood fiber board.

In the preferred embodiment of the present invention, the wear-resistant plate 20 is made of wear-resistant material that is non-combustible, flame-resistant, and fire-proof, and has a low friction coefficient.

In practice, the wax layer 40 is coated on and filled with the grooves 30 of the wear-resistant plate 20 and has a coating height equal to the depth of each of the grooves 30, so that when the wax layer 40 is cured, the wax layer 40 is evenly filled with and hidden in the grooves 30 of the wear-resistant plate 20.

When the user is running on the walking board assembly, the walking belt 1 is rotated and contacts the wax layer 40 in the grooves 30 of the wear-resistant plate 20 and the top face of the wear-resistant plate 20 between the grooves 30. Thus, the walking belt 1 rubs the top face of the wear-resistant plate 20 quickly and successively for a long period of time during rotation of the walking belt 1, so that the friction coefficient between the walking belt 1 and the wear-resistant plate 20 is increased gradually. At this time, the temperature in the wax layer 40 is increased gradually so that the wax in the wax layer 40 is softened and changed from a solid state to a fluid state slowly. Then, the wax is drawn out by the walking belt 1 to increase the lubricating effect between the inner face of the walking belt 1 and the top face of the wear-resistant plate 20, to decrease the friction resistance of the walking belt 1, to reduce the electric current of the motor, to enhance the lifetime of the walking belt 1 and the motor, and to reduce the noise caused by frequent friction. On the contrary, when the walking belt 1 is rotated slowly or stops rotating, the friction coefficient between the walking belt 1 and the wear-resistant plate 20 is decreased gradually so that the temperature in the wax layer 40 is decreased gradually, and the wax of the wax layer 40 is cured slowly.

In addition, the wax layer 40 is hidden in the grooves 30 of the wear-resistant plate 20 to provide the wax during a long-term utilization, so that the wax layer 40 will not be quickly carried away by the walking belt 1 and will not be exhausted due to frequent friction. Thus, the user or operator needs not to add the wax frequently, and the wax of the wax layer 40 will not produce an overflow, to ensure the lubricating effect between the inner face of the walking belt 1 and the top face of the wear-resistant plate 20 during a long-term utilization, and to decrease the friction resistance of the walking belt 1.

Further, the top face of the wear-resistant plate 20 is provided with the grooves 30, so that the inner face of the walking belt 1 and the top face of the wear-resistant plate 20 contact and rub each other in a surface to line manner rather than in a surface-to-surface manner, so that the friction resistance and the noise caused by the friction is further reduced. At the same time, the wear-resistant plate 20 is made of wear-resistant material with a low friction coefficient so that the wear-resistant plate 20 is wear-proof without scratch.

Figure 5:
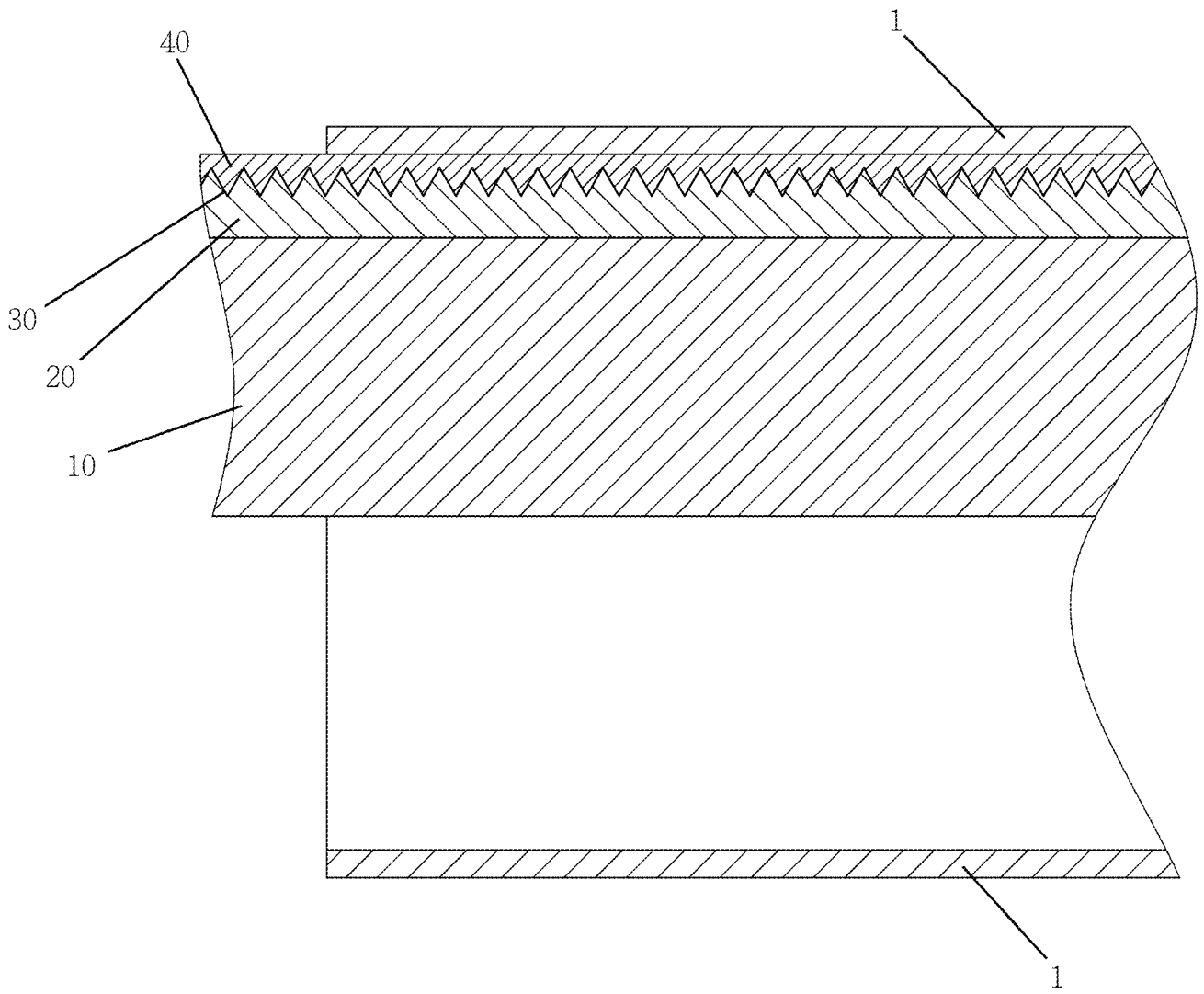
FIG. 5 is a locally enlarged side cross-sectional view of a treadmill in accordance with the second preferred embodiment of the present invention.

Referring to FIG. 5 with reference to FIGS. 1-4, after the wax layer 40 is coated on and filled with the grooves 30 of the wear-resistant plate 20, the wax layer 40 is made to have a coating height slightly protruding from the depth of each of the grooves 30 or slightly higher than the top face of the wear-resistant plate 20.

In practice, the wax layer 40 protrudes from and higher than the top face of the wear-resistant plate 20 so that when the walking belt 1 is rotated, the walking belt 1 directly contacts and rubs the wax layer 40, to increase the lubricating effect and decrease the friction resistance between the inner face of the walking belt 1 and the top face of the wear-resistant plate 20. After the height of the wax layer 40 is lowered gradually during a long-term utilization, the walking belt 1 rubs the wax layer 40 in the grooves 30 and the top face of the wear-resistant plate 20 between the grooves 30 simultaneously.

Thus, the wax layer 40 with more vertical thickness is used for a longer period of time, to elongate the time for adding and replenishing the wax layer 40, and to reduce the time for maintenance and repair of the walking board assembly.

Moreover, the grooves 30 is directly formed in the wear-resistant plate 20 integrally, without needing a secondary working process, to prevent from producing a large amount of powder and dust. Further, the grooves 30 and the solidified wax the wax layer 40 cooperate to reduce the friction resistance between the inner face of the walking belt 1 and the top face of the wear-resistant plate 20.

Accordingly, the inner face of the walking belt 1 and the top face of the wear-resistant plate 20 contact and rub each other in a surface to line manner, the wax layer 40 in the grooves 30 supplies the wax during a long period of time, and the wear-resistant plate 20 has a wear-proof feature, so that the walking board assembly is resistant to wear, has low friction resistance, has high lubrication, extends the lubricating effect between the walking belt 1 and the wear-resistant plate 20, does not produce powder and dust, reduces the electric current of the motor, increases the lifetime of the walking belt 1, the motor, and other parts of the walking board assembly, and reduces the noise due to friction. In addition, the walking board assembly is used conveniently and is available for treadmills of different kinds.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A treadmill comprising:

a walking board assembly; and a walking belt encircling the walking board assembly;

wherein:

the walking board assembly includes a support plate, a wear-resistant plate mounted on the support plate, and a wax layer mounted on the wear-resistant plate;

the support plate is made of a composite wooden board;

the wear-resistant plate is made of wear-resistant material;

the wear-resistant plate is hard and has a low friction coefficient;

the wear-resistant plate has a bottom face abutting a top face of the support plate;

the wear-resistant plate has a top face integrally formed with multiple grooves;

each of the grooves has a depth of 0.01 mm to 0.2 mm;

the wear-resistant plate has a thickness less than that of the support plate;

the wax layer is coated on and filled with the grooves of the wear-resistant plate; and the wax layer has a coating height at least equal to the depth of each of the grooves.

2. The treadmill as claimed in claim 1, wherein the coating height of the wax layer is higher than and protrudes from the depth of each of the grooves.

3. The treadmill as claimed in claim 1, wherein the coating height of the wax layer is higher than the top face of the wear-resistant plate.

4. The treadmill as claimed in claim 1, wherein each of the grooves are arranged longitudinally in the top face of the wear-resistant plate.

5. The treadmill as claimed in claim 1, wherein each of the grooves are arranged regularly in the top face of the wear-resistant plate.

6. The treadmill as claimed in claim 1, wherein each of the grooves are arranged irregularly in the top face of the wear-resistant plate.

7. The treadmill as claimed in claim 1, wherein the wear-resistant plate is made of a high-pressure decorative laminate.

8. The treadmill as claimed in claim 1, wherein the wear-resistant plate is made of a Bakelite board.

9. The treadmill as claimed in claim 1, wherein the wear-resistant plate is made of a high-density wood fiber board.

10. The treadmill as claimed in claim 1, wherein the wear-resistant plate is made of wear-resistant material that is non-combustible, flame-resistant, and fire-proof, and has the low friction coefficient.

* * * * *